US006102722A

United States Patent [19]

Arnett

[11] Patent Number: 6,102,722

[45] Date of Patent: Aug. 15, 2000

[54] UPGRADEABLE COMMUNICATION CONNECTOR

[75] Inventor: Jaime Ray Arnett, Fishers, Ind.

[73] Assignee: Lucent Technologies Inc., Murray Hill, N.J.

[21] Appl. No.: 09/221,093

[22] Filed: Dec. 28, 1998

[51] Int. Cl.[7] ..... H01R 29/00

[52] U.S. Cl. ..... 439/189; 439/676

[58] Field of Search ..... 439/189, 676, 439/941, 620

[56] References Cited

U.S. PATENT DOCUMENTS

| | | | |
|---|---|---|---|
| 4,556,264 | 12/1985 | Tanaka | 439/62 |
| 5,096,442 | 3/1992 | Arnett et al. . | |
| 5,228,872 | 7/1993 | Liu | 439/676 |
| 5,419,720 | 5/1995 | Chen | 439/676 |
| 5,503,572 | 4/1996 | White et al. | 439/676 |
| 5,647,767 | 7/1997 | Scheer et al. . | |
| 5,674,093 | 10/1997 | Vaden . | |
| 5,989,069 | 11/1999 | Tan | 439/676 |

*Primary Examiner*—Renee Luebke
*Assistant Examiner*—T. C. Patel
*Attorney, Agent, or Firm*—Law Offices of Leo Zucker

[57] ABSTRACT

An upgradeable communication connector for use in wired telecommunication networks. The connector has a connector housing with an upgrade component passage for receiving an electrical upgrade component having at least one electrical contact terminal. A number of electrically conductive connector terminals are supported by the housing. The connector terminals have first end portions for contacting a mating connector, and second end portions for making electrical connections between the connector terminals and outside circuits. At least one of the connector terminals has a contact portion in the region of the upgrade component passage for electrically contacting a contact terminal of the upgrade component when the component is within the component passage.

18 Claims, 3 Drawing Sheets

UPGRADEABLE COMMUNICATION CONNECTOR

BACKGROUND OF THE INVENTION

1. Field of the Invention

This invention relates to telecommunication connectors, and particularly to a connector that can be upgraded to perform at higher frequencies and data rates without replacement of the entire connector.

2. Discussion of the Known Art

There is a growing need for telecommunication connectors capable of higher data transmission rates than those needed in the past, to accommodate advanced wired communication networks and systems. Various approaches to accomplish higher connector performance levels include designs that differ significantly from lower performance connectors made by the same manufacturer. Thus, additional outlays for new parts tooling and maintenance, fixtures, and other equipment, are required to produce such connectors. See, e.g., U.S. Pat. No. 5,674,093 issued Oct. 7, 1997.

Communication connectors incorporating printed circuit or wire boards to achieve high performance are also known. For example, various configurations of wire traces may be printed on the boards to improve connector transmission characteristics, for example, by compensating for crosstalk introduced by other, mating connectors. In communication jacks having spring jackwires, ends of the jackwires are typically soldered or otherwise electrically connected to terminals on the circuit boards. See copending U.S. patent application Ser. No. 08/904,391 filed Aug. 1, 1997 (now U.S. Pat. No. 5,924,896 issued Jul. 20, 1999), and assigned to the assignee of the present invention and application. All relevant portions of the '391 application are incorporated by reference herein.

U.S. Pat. No. 5,647,767 (Jul. 15, 1997) shows a connector jack assembly having network signal conditioning components such as choke coils, filter circuits and transformers, connected in series with contact terminals which engage a mating connector plug. The components are arranged on a printed circuit board with contact pads on both sides of the board. If the board is removed, the jack assembly is rendered inoperative, however.

There are significant manufacturing cost and pricing differences among connectors having different performance levels. Higher prices for high performance connectors (e.g., connectors specified by EIA/TIA 568A, category 5) reflect the mentioned need for more piece parts per unit, and greater complexity of these parts and their assembly. Nevertheless, there remains a need for relatively lower performance connectors, typically for use in voice communication systems where connectors usually have a performance level specified by EIA/TIA 568A, category 3.

Because of the current need for communication connectors having different performance ratings, a connector construction that can be modified relatively inexpensively, and which uses common parts and assembly operations, would be very desirable. As mentioned, manufacturers currently tend to use different parts and tooling for each series of connectors at a given performance level.

SUMMARY OF THE INVENTION

According to the invention, an upgradeable communication connector includes a connector housing, and a number of electrically conductive connector terminals supported by the housing. The connector terminals have first end portions for contacting a mating connector, and second end portions for making electrical connections between the connector terminals and outside circuits. The connector housing has an upgrade component passage that is dimensioned and arranged to receive an electrical upgrade component, wherein the upgrade component has at least one electrical contact terminal. At least one of the connector terminals supported by the housing has a contact portion in the region of the upgrade component passage for making electrical contact with the contact terminal of the upgrade component when the component is within the component passage.

For a better understanding of the invention, reference is made to the following description taken in conjunction with the accompany drawing and the appended claims.

DETAILED DESCRIPTION OF THE INVENTION

Figure 1:
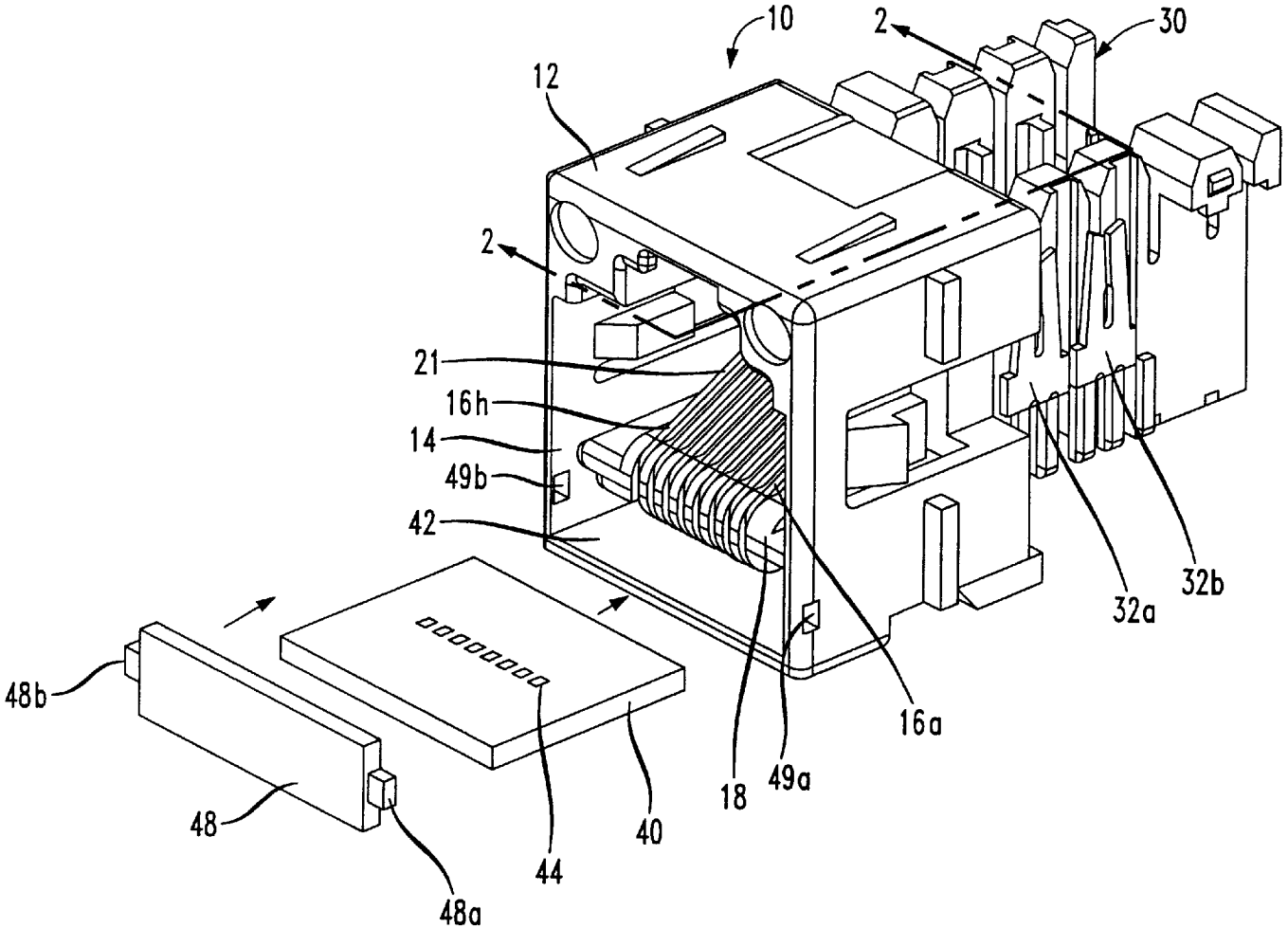
FIG. 1 is a perspective view of a communication connector showing an electrical upgrade component about to be positioned in the connector, according to a first embodiment of the invention.

FIG. 1 is a perspective view of a communication connector 10 according to a first embodiment of the invention. In the illustrated embodiment, connector 10 is a telephone cable jack connector having an overall construction similar to one disclosed in U.S. Pat. No. 5,096,442 issued Mar. 17, 1992, but with certain improvements allowing the connector 10 to be modified at the user's option to enhance its electrical performance, as explained below. All relevant portions of the '442 patent are incorporated by reference herein. Connector 10 has a housing 12 in the form of a dielectric, i.e., non-electrically conductive material (e.g., polycarbonate, ABS, and blends thereof) which material meets all applicable standards with respect to electrical insulation and flammability.

The connector housing 12 has a front opening 14 for receiving a mating connector (not shown in FIG. 1). A number of elongate electrically conductive connector terminals in the form of, for example, eight elongated spring jackwires 16*a*–16*h* are supported by a jackwire block 18 inside the housing 12. Upper, free ends of the jackwires 16*a*–16*h* are seated in corresponding vertical slots which are formed in a partial wall 20 within the housing 12. The slots act to guide and to keep each of the jackwires 16*a*–16*h* separated from one another as they deflect downward when a plug connector is inserted through the housing front opening 14. Wire terminals exposed on the plug connector may then establish electrical contact with first end portions 21 of the jackwires, inside the housing 14.

Connector 10 also has an associated terminal housing 30 which may be formed of the same or similar dielectric material as the connector housing 12. The terminal housing 30 is fixed against a rear surface of the connector housing as viewed in FIG. 1, and substantially encloses, for example, eight jackwire terminals 32*a*–32*h*. See FIGS. 2 and 3. The jackwire terminals 32*a*–32*h* may be in the form of known insulation displacement connector (IDC) terminals that allow an insulated wire (not shown) to make electrical contact with a given one of the jackwire terminals 32*a*–32*h* by sliding the wire down an exposed, open slot (e.g., slot 33*a* in FIG. 2) in the given terminal. In the illustrated embodiments, the jackwire terminals 32*a*–32*h* are formed in connection with second end portions 33 of the spring jackwires 16*a*–16*h*, and thus allow electrical connections to be made between the jackwires and outside circuits through wires that are inserted in the slots of the jackwire terminals.

The jackwire block 18 may also be formed integrally with the terminal housing 30 and, in the illustrated embodiments, the jackwire block 18 protrudes through an opening 34 in the rear surface of the connector housing 12. Further details concerning the terminal housing 30, the spring jackwires, jackwire terminals, and the jackwire block may be found in the mentioned U.S. Pat. No. 5,096,442.

To upgrade the electrical performance characteristics of the connector 10, an electrical upgrade component 40 which may be in the form of a printed circuit or wire board, can be incorporated in the connector 10 by inserting the component 40 through the front opening 14 of the connector housing 12. Component 40 may be, for example, a single or multi-layer dielectric board having wire traces printed on one or more layers, or any structure that supports or contains parts capable of electrically interacting with the jackwires 16*a*–16*h*, to affect the performance of the connector 10. Such parts, alone or in combination with other discrete devices carried by the component 40, serve to reduce or cancel crosstalk that would otherwise be produced across certain ones of the jackwires 16*a*–16*h* when another connector is joined to the connector 10. See the earlier mentioned '391 application.

Figure 2:
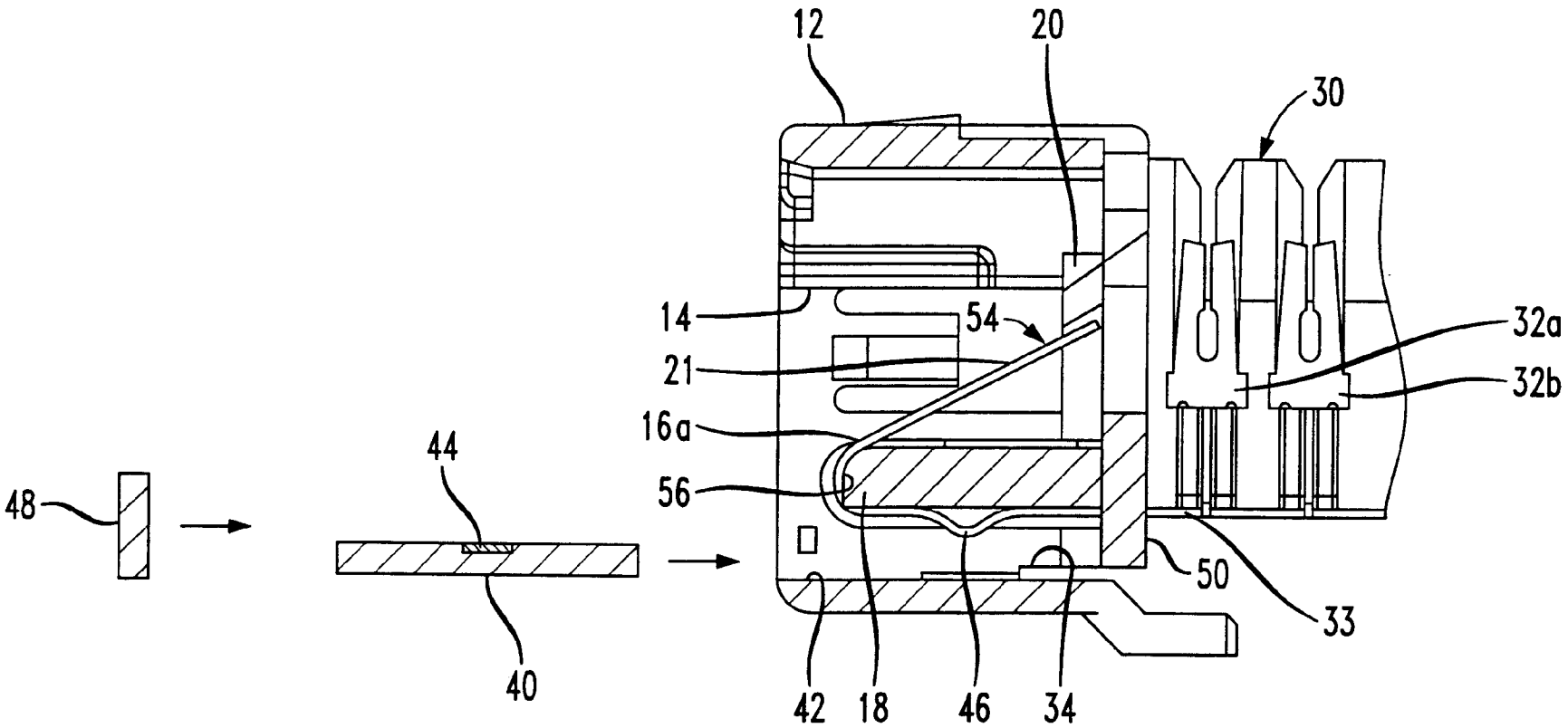
FIG. 2 is a view of the connector as seen in cross-section along line 2—2 in FIG. 1.
Figure 3:
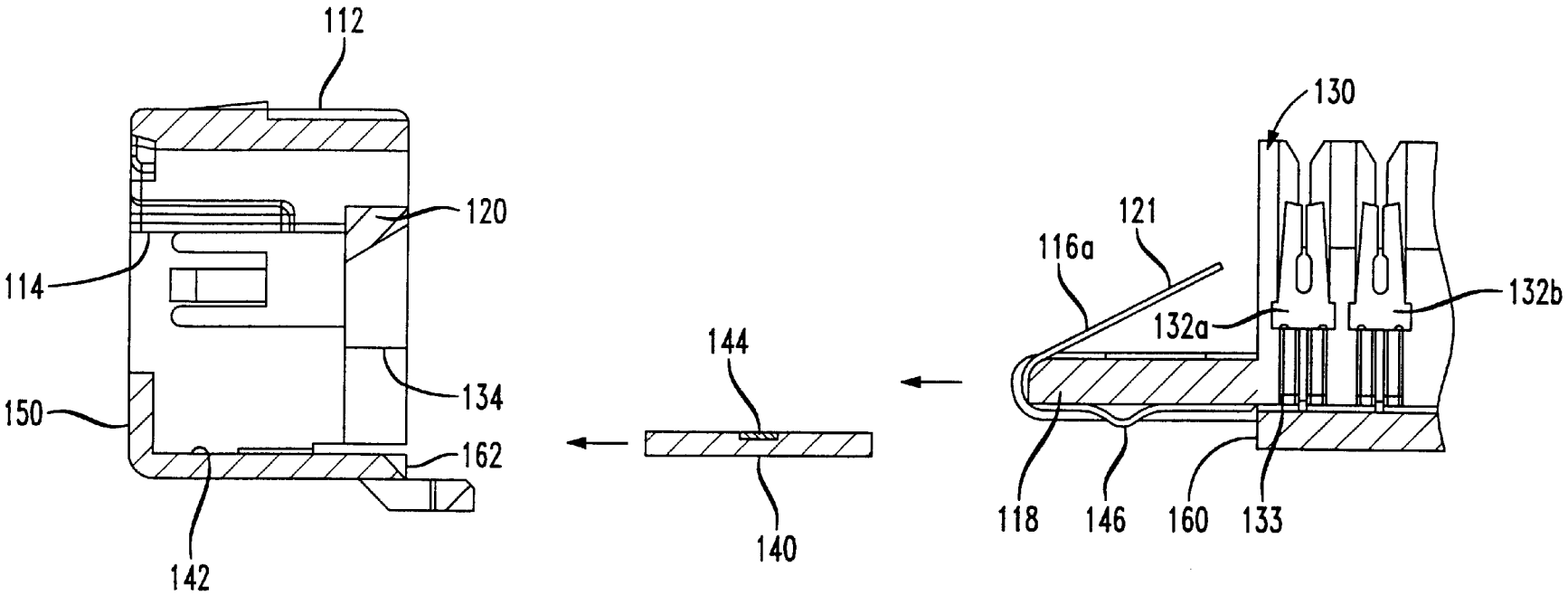
FIG. 3 is a side view in cross-section of a communication connector and an electrical upgrade component according to a second embodiment of the invention.

In the disclosed embodiment, an upgrade component space or passage 42 is formed in the connector housing 12, in a region just below the jackwire block 18 as viewed in the drawing. When the component 40 is positioned in the passage 42, one or more contact pads 44 on an upper surface of the component 40 establish electrical connections with corresponding contact portions 46 formed in the jackwires 16*a*–16*h*. As shown in FIGS. 2 and 3, the contact portions 46 may be in the form of "bumps" in the jackwires which protrude arcuately beneath the jackwire block 18, and extend into the upgrade component passage 42 by an amount sufficient to confront the upper surface of the component 40, when the component is placed in the passage 42. The contact pads 44 are so located on the component 40 as to make electrical contact with corresponding contact portions 46 on the jackwires, when the component is fully inserted in the passage 42.

In the embodiment of FIGS. 1 and 2, the component 40 is blocked against further displacement toward the rear of the connector housing 12 by an upstanding lip 50 at the rear of the housing 12. The contact pads 44 on the component 40 and the contact portions 46 of the jackwires 16*a*–16*h*, may be gold plated or otherwise treated to maintain reliable electrical connections with one another and to prevent corrosion during use. Importantly, even in the absence of the component 40, the connector 10 will nonetheless operate at a known level of performance.

An elastic, generally rectangular cover or door 48 has a pair of side ears 48*a*, 48*b* which are shown in FIG. 1. When the upgrade component 40 is fully inserted in the passage 42, the cover 48 can be snapped in corresponding slots 49*a*, 49*b* formed in side walls of She component passage 42, near the front face of the connector housing 12. In addition to protecting the upgrade component 40 and the jackwires 16*a*–16*h* from the outside environment, cover 48 prevents the upgrade component from moving away from a position where it electrically contacts certain contact portions 46 of the jackwires inside the connector housing 12.

The cover 48 may be marked for circuit identification such as "Line 1,", "Data", "Ext. 40", or the like, and may also be available in various colors for user identification of the connector 10. If the component 40 is not placed in the passage 42, the cover 48 may still be snapped in position to shield the passage 42 and the jackwire contact portions 46 from dirt and debris that could otherwise enter the passage 42.

FIG. 2 is a side view of the connector 10 taken in section along line 2—2 in FIG. 1. As shown, when the upgrade component 40 is fully inserted in the passage 42, contact pads 44 on the surface of the component make electrical contact with corresponding contact portions 46 of the jackwires 16*a*–16*h*. Not all jackwires or pairs of jackwires may require electrical compensation via the component 40 to achieve various levels of performance. For example, only the center four jackwires 16*c*–16*f* may require additional compensation to meet the mentioned Category 5 performance requirements.

It can be seen in FIG. 2 that when a mating plug is inserted in the connector front opening 14, the plug will apply deflecting forces in the direction of arrow 54 on the free ends of the jackwires 16*a*–16*h*, above the jackwire block 18. These forces are conducted to the contact portions 46 of the jackwires in such a way as to urge the contact portions further against the contact pads 44 on an inserted upgrade component 40. That is, the jackwires tend to pivot about a front end 56 of the jackwire block 18 in a clockwise direction as viewed in FIG. 2, when the plug 52 is joined to the connector 10. The front end 56 of the jackwire block may be formed with a curvilinear cross-section as in FIG. 2, so as to prevent the spring jackwires 16*a*–16*h* from bending permanently at the front end of the block 18 when a plug is inserted in the connector front opening 14.

FIG. 3 shows an arrangement wherein an upgrade component 140 is installed from the rear of a connector housing 112. Parts the same or similar to those shown in FIGS. 1 and 2 have corresponding reference numerals increased by 100 in FIG. 3.

In FIG. 3, the connector housing has a front lip 150 that covers one end of an upgrade component passage 142, at the front of connector housing 112. The housing 112 has a front opening 114 for receiving a mating connector (not shown). A rear surface of the connector housing 112 has an opening 134 for receiving a jackwire block 118 of a terminal housing 130, with spring jackwires 116*a*–116*h* supported around the block 118.

The upgrade component 140 is positioned in the passage 142 by inserting the component 140 through the opening 134, until a leading end of the component abuts the front lip 150 of the connector housing. The jackwire block 118 with the jackwires 116*a*–116*h* is then inserted through the housing rear opening 134, until a base part 160 of the terminal housing 130 abuts a rear body part 162 of the connector housing 112. When so joined to the connector housing 112, the terminal housing 130 covers the rear opening 134 in the connector housing 112 including the upgrade component passage 142. The terminal housing 130 also acts to maintain the upgrade component 140 at an operative position in the passage 142 where contact pads 144 on the component establish electrical connections with corresponding contact portions 146 of the jackwires 116*a*–116*h*. As in the embodiment of FIGS. 1 and 2, the connector is operative with a certain level of performance even if the upgrade component 140 is withdrawn from the connector housing 112.

For applications that require relatively low performance, the connector 10 may be used without the upgrade component 40 (or 140). This would allow a "least costly" version of the connector 10. For higher levels of performance, the component 40 with appropriate electrical compensation may be added. For example, wire traces on or within a component printed wire board could be configured in a known manner to enhance performance by adding capacitive crosstalk, thus allowing the connector 10 to perform at higher data transmission rates.

Components 40 in the form of printed wire boards having different trace configurations could be used to achieve different levels of performance. The boards may be comprised of multiple layers of wire traces alone or in combination with discrete components, to facilitate the performance enhancement. Any future improvements made available by way of an upgrade component similar to the component 40 may be incorporated in the connector 10, without requiring any modification of remaining parts of the connector, or of its assembly operations.

The connector 10 may also be upgraded in the field by adding or replacing an existing component 40 with an improved one. This is a very useful feature as data transmission rates continue to increase resulting in higher performance requirements for communication connectors.

While the foregoing description represents preferred embodiments of the invention, it will be obvious to those skilled in the art that various changes and modifications may be made, without departing from the true spirit and scope of the invention.

I claim:

1. A communication connector construction, comprising:

a connector housing; and a number of electrically conductive, elongated jackwires supported by the housing, wherein each of the jackwires has a first end portion arranged for contacting a mating connector, and a second end portion arranged to establish an electrical connection with an outside circuit;

said connector housing has a component receiving passage for receiving an electrical component that is insertable from outside the housing; and a number of the jackwires have contact portions intermediate the first and the second end portions of the jackwires and positioned in the region of the component receiving passage of the connector housing, and said contact portions extend into the component receiving passage by an amount sufficient to make electrical contact with the electrical component when said component is inserted in the component receiving passage.

2. A connector construction according to claim 1, wherein the connector housing has a front surface formed with a front opening for receiving said mating connector, and wherein the front opening is also formed to receive the electrical component.

3. A connector construction according to claim 1, including a jackwire block inside the connector housing, said block being constructed and arranged to support the jackwires for engagement with terminals of said mating connector.

4. A connector construction according to claim 3, wherein said component receiving passage is disposed adjacent the jackwire block.

5. A connector construction according to claim 1, wherein the contact portion of at least one of said jackwires is in the form of an arcuate protrusion that extends into the component receiving passage by an amount sufficient to make electrical contact with a corresponding contact terminal of said electrical component.

6. A connector construction according to claim 1, including a door constructed and arranged to be detachably fastened to the connector housing for covering the component receiving passage.

7. A connector construction according to claim 3, including a terminal housing fixed adjacent the connector housing, and a number of wire connector terminals supported on the terminal housing and electrically connected to corresponding second end portions of the jackwires.

8. A connector construction according to claim 7, wherein said jackwire block is formed with the terminal housing to protrude through a rear opening in the connector housing.

9. A connector construction according to claim 8, wherein said rear opening is formed to receive the electrical component for insertion in the component receiving passage.

10. A communication connector assembly, comprising:

an electrical component constructed and arranged in the form of a circuit board having a number of contact terminals;

a connector housing; and a number of electrically conductive, elongated jackwires supported by the housing, wherein each of the jackwires has a first end portion arranged for contacting a mating connector, and a second end portion arranged to establish an electrical connection with an outside circuit;

said connector housing has a component passage for receiving the electrical component; and a number of the jackwires have contact portions intermediate the first and the second end portions of the jackwires and positioned in the region of the component passage of the connector housing, and said contact portions extend into the component passage by an amount sufficient to make electrical contact with the electrical component in the component passage.

11. The assembly of claim 10, wherein the connector housing has a front surface formed within a front opening for receiving said mating connector, and said component passage opens into said front surface.

12. The assembly of claim 10, including a jackwire block inside the connector housing, said block being constructed and arranged to support the jackwires for engagement with terminals of said mating connector.

13. The assembly of claim 12, wherein said component passage is disposed adjacent the jackwire block.

14. The assembly of claim 10, wherein the contact portion of at least one of said jackwires is in the form of an arcuate protrusion that extends into the component passage by an amount sufficient to make electrical contact with a corresponding contact terminal of said electrical component.

15. The assembly of claim 10, including a door constructed and arranged to be detachably fastened to the connector housing for covering the component passage.

16. The assembly of claim 12, including a terminal housing fixed adjacent the connector housing, and a number of wire connector terminals supported on the terminal housing and electrically connected to corresponding second end portions of the jackwires.

17. The assembly of claim 16, wherein said jackwire block is formed with the terminal housing to protrude through a rear opening in the connector housing.

18. The combination of claim 17, wherein said component passage opens into said rear surface.

* * * * *